US006186684B1

(12) United States Patent
Bane et al.

(10) Patent No.: US 6,186,684 B1
(45) Date of Patent: Feb. 13, 2001

(54) REWINDING UNIT FOR LINERLESS LABEL WEB AND METHOD

(75) Inventors: John C. Bane, Albuquerque, NM (US); Jeffrey J. Boreali, North Tonawanda, NY (US)

(73) Assignee: Moore Business Forms, Inc., Grand Island, NY (US)

( * ) Notice: Under 35 U.S.C. 154(b), the term of this patent shall be extended for 0 days.

(21) Appl. No.: 08/597,584

(22) Filed: Feb. 2, 1996

(51) Int. Cl.[7] ..... B41J 15/04
(52) U.S. Cl. ..... 400/614; 400/611; 400/613
(58) Field of Search ..... 400/611, 613, 400/614, 619

(56) References Cited

U.S. PATENT DOCUMENTS

| | | | | |
|---|---|---|---|---|
| 2,049,030 | | 7/1936 | Strauss . | |
| 2,500,549 | | 3/1950 | Ketay et al. . | |
| 3,620,161 | | 11/1971 | Doran et al. . | |
| 4,065,068 | * | 12/1977 | Treadwell | 400/614 |
| 4,120,245 | * | 10/1978 | Karp et al. | 400/614 |
| 4,546,011 | | 10/1985 | Wolfrum . | |
| 4,617,199 | | 10/1986 | Galli et al. . | |
| 4,627,641 | | 12/1986 | Kawacuchi . | |
| 4,700,906 | * | 10/1987 | Lapadakis | 400/614 |
| 4,851,383 | | 7/1989 | Fickenscher et al. . | |
| 4,869,941 | | 9/1989 | Ohki . | |
| 4,911,477 | | 3/1990 | Shishido . | |
| 4,978,146 | | 12/1990 | Warther et al. . | |
| 5,103,583 | | 4/1992 | VanErmen . | |
| 5,160,943 | | 11/1992 | Pettigrew et al. . | |
| 5,180,607 | | 1/1993 | Umise et al. . | |
| 5,201,976 | | 4/1993 | Eastin . | |
| 5,273,798 | | 12/1993 | Miner . | |
| 5,284,689 | | 2/1994 | Laurash et al. . | |
| 5,346,259 | | 9/1994 | Mocilnikar et al. . | |
| 5,413,383 | | 5/1995 | Laurash et al. . | |
| 5,418,026 | | 5/1995 | Dronzek, Jr. et al. . | |
| 5,423,620 | * | 6/1995 | Tokairin | 400/618 |
| 5,560,293 | * | 10/1996 | Boreali et al. | 400/621 |

FOREIGN PATENT DOCUMENTS

| | | |
|---|---|---|
| 2227460 | 8/1990 | (GB) . |
| 61-044696 | 3/1986 | (JP) . |
| 61-158496 | 7/1986 | (JP) . |
| WO 95/31378 | 11/1995 | (WO) . |

* cited by examiner

*Primary Examiner*—John S. Hilten
(74) *Attorney, Agent, or Firm*—Nixon & Vanderhye

(57) ABSTRACT

A rewinding apparatus is configured to accommodate linerless labels. The apparatus includes a thermal printer for processing an unprinted roll of labels, a rewinder disposed in the vicinity of the thermal printer for rewinding the printed roll after the unprinted roll is processed by the thermal printer, and a base plate supporting the rewinder to position the rewinder in a predetermined position relative to the thermal printer. With linerless labels, the roll of processed labels is wound spaced from a rewinder main body to avoid catching the media adhesive on a side guide, thereby preventing bubbles and wrinkles from being induced in the rewound roll.

19 Claims, 1 Drawing Sheet

REWINDING UNIT FOR LINERLESS LABEL WEB AND METHOD

BACKGROUND OF THE INVENTION

The present invention relates to an apparatus and method for winding a printed roll of linerless labels and, more particularly, to an apparatus and method for winding a printed roll of linerless labels from an unprinted roll of linerless direct thermal or thermal transfer ribbon labels.

Conventional labels generally include a pressure sensitive adhesive fixed to the non-printing side of the substrate that is mounted on a liner, which has been coated with a release coating. The liner acts as a support for transport, printing and storage, and after the label is removed from the liner, it must be disposed of.

Preprinted labels are processed using a printing unit that unwinds the rolled unprinted labels, prints a repeating pattern on the labels and dispenses the printed labels to a rewinding unit. The rewinding unit has a main body section and a rotatable shaft and rewinds the labels into a printed roll for subsequent customer use. The main body of the rewinder is used as a side guide to ensure that the rewound roll is even. Alternative rewinding units include plastic disks that are placed on each side of the rewinding roll for added evening of the roll.

Linerless labels are known to have advantages over conventional pressure sensitive labels. The linerless label has tis substrate face coated with a release coating and its substrate back with a pressure sensitive adhesive (PSA), and is wound in a roll configuration so that the PSA is in contact with the release coating, and the release coating faces outwardly. The linerless construction offers advantages and lower costs due to substantial material reduction, elimination of disposal concerns and costs associated with release coated liners, and in providing approximately twice as many labels per roll. One such linerless label is disclosed in U.S. Pat. No. 4,851,383. The labels described in that patent have a thermosensitive layer with dye for forming color images, and a silicone release coating. It is necessary to provide a barrier layer between the silicone release layer and the thermosensitive material, which increases the costs of production of the linerless labels.

Because the structure of the linerless labels sticks to itself when wound in a roll, the roll will not slide off itself, and side guides for rewinding are not necessary. In particular, side guides contribute potential catch points for the media's adhesive. Once the media catches, bubbles and wrinkles may be induced in the rewound roll.

SUMMARY OF THE INVENTION

It is therefore an object of the invention to provide an apparatus and method for winding a printed roll of linerless labels from an unprinted roll of linerless labels.

This and other objects and advantages of the invention are achieved by providing an apparatus for winding a printed roll of linerless labels from an unprinted roll of linerless labels. The apparatus includes a thermal printer that processes the unprinted roll of labels; a rewinder disposed in a vicinity of the thermal printer, wherein the rewinder winds the printed roll after the unprinted roll is processed by the thermal printer; and a base plate supporting the rewinder, wherein the base plate is configured to position the rewinder in a predetermined position relative to the thermal printer.

The thermal printer may include a sensor such as a reflective sensor that senses a sense mark on the unprinter roll of labels to register thermal printing. The base plate may be offset from the thermal printer by a predetermined amount of, for example, about 0.375".

The rewinder is preferably provided with a rotatable shaft extending from a rewinder main body. The rotatable shaft supports the printed roll, wherein the base plate is positioned relative to the thermal printer such that when the printed roll is wound on the rewinder, the printed roll is spaced from the rewinder main body by, for example, about 0.375".

The thermal printer may be provided with one of a location hole and a location post, wherein the base plate is provided with the other of the location hole and the location post. The base plate is positioned relative to the thermal printer by the location hole and the location post. An additional one of the location hole and the location post may further be provided that alternatively positions the base plate relative to the thermal printer.

In accordance with another aspect of the invention, there is provided an apparatus for winding a printed roll of linerless labels, the printed roll being dispensed from a printed roll dispenser. The apparatus includes a rewinder disposed in a vicinity of the dispenser and including a rotatable shaft, wherein the rewinder winds the printer roll on the shaft; and a base plate supporting the rewinder, wherein the base plate is configured to position the rewinder in a predetermined position relative to the dispenser.

In accordance with yet another aspect of the invention, there is provided a method of winding a printer roll of linerless labels from an unprinted roll of linerless labels using the apparatus of the invention. The method includes positioning the base plate and the rewinder offset relative to the thermal printer; and winding the printed roll onto the rewinder while maintaining the printed roll spaced from a main body of the rewinder.

The positioning step may include positioning the base plate about 0.375" offset relative to the thermal printer, and the winding step may include winding the printing roll onto the rewinder while maintaining the printed roll spaced about 0.375" from the main body.

In accordance with still another aspect of the invention, there is provided a method of dispensing linerless labels. The method includes (a) providing a supply of linerless labels having a thermosensitive coating on a first side and an adhesive coating on a second side; (b) feeding the supply of linerless labels through a printer; (c) configuring the printer to process a predetermined number of linerless labels; (d) printing on one of the first and second sides of the linerless labels to produce at least a first batch; (e) winding the first batch of printer linerless labels with a rewinder; and (f) removing the first batch of printer linerless labels from the rewinder for subsequent application. Preferably, steps (c) through (e) are practiced to produce a second batch of linerless labels.

BRIEF DESCRIPTION OF THE DRAWINGS

These and other aspects and advantages of the invention will become apparent from the following detailed description of preferred embodiments when read in conjunction with the accompanying drawings, in which.

DETAILED DESCRIPTION OF PREFERRED EMBODIMENTS

Figure 1:
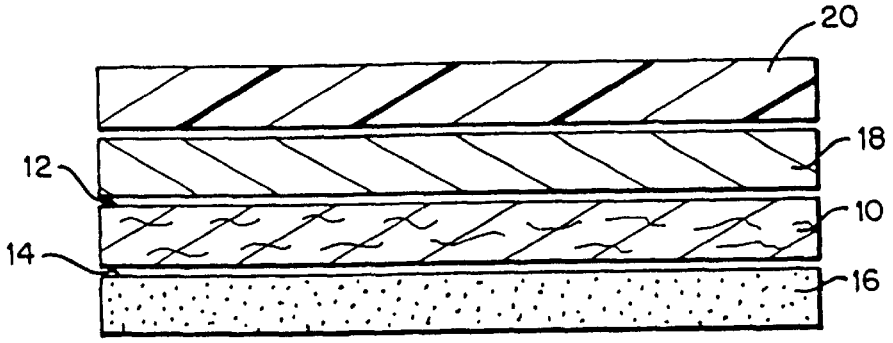
FIG. 1 is a cross-sectional view of a linerless label.

FIG. 1 shows a cross-section of a linerless label. In general, the linerless label includes a label 10 having a first face 12 and a second face 14. An adhesive 16 is layered on the second face 14. A thermosensitive layer 18 is provided on the first face 12 of the label, and a silicone layer 20 is provided over the thermosensitive layer 18. In a thermal transfer ribbon linerless label, a thermal transfer ribbon is provided on the first face 12 of the label 10 and acts as a primary release layer; a secondary silicone release layer may or may not be provided between the first face 12 and the thermal transfer ribbon.

The adhesive 16 is preferably applied directly to the second face 14 of the substrate 10. However, as disclosed in co-pending application Ser. No. 07/912,851, filed Jul. 13, 1992, a tied coating may be provided if necessary to secure proper adhesion between the adhesive 16 and the substrate 10.

The thermosensitive layer 18 is rolled with the substrate 10 prior to processing such that the silicone release layer 20 is on the outside of the roll. Similarly, with a thermal transfer ribbon label, the ribbon is rolled with the substrate. The label stock is preferably pre-perforated, enabling subsequent processing (either manual or automatic) without a cutter.

Figure 2:
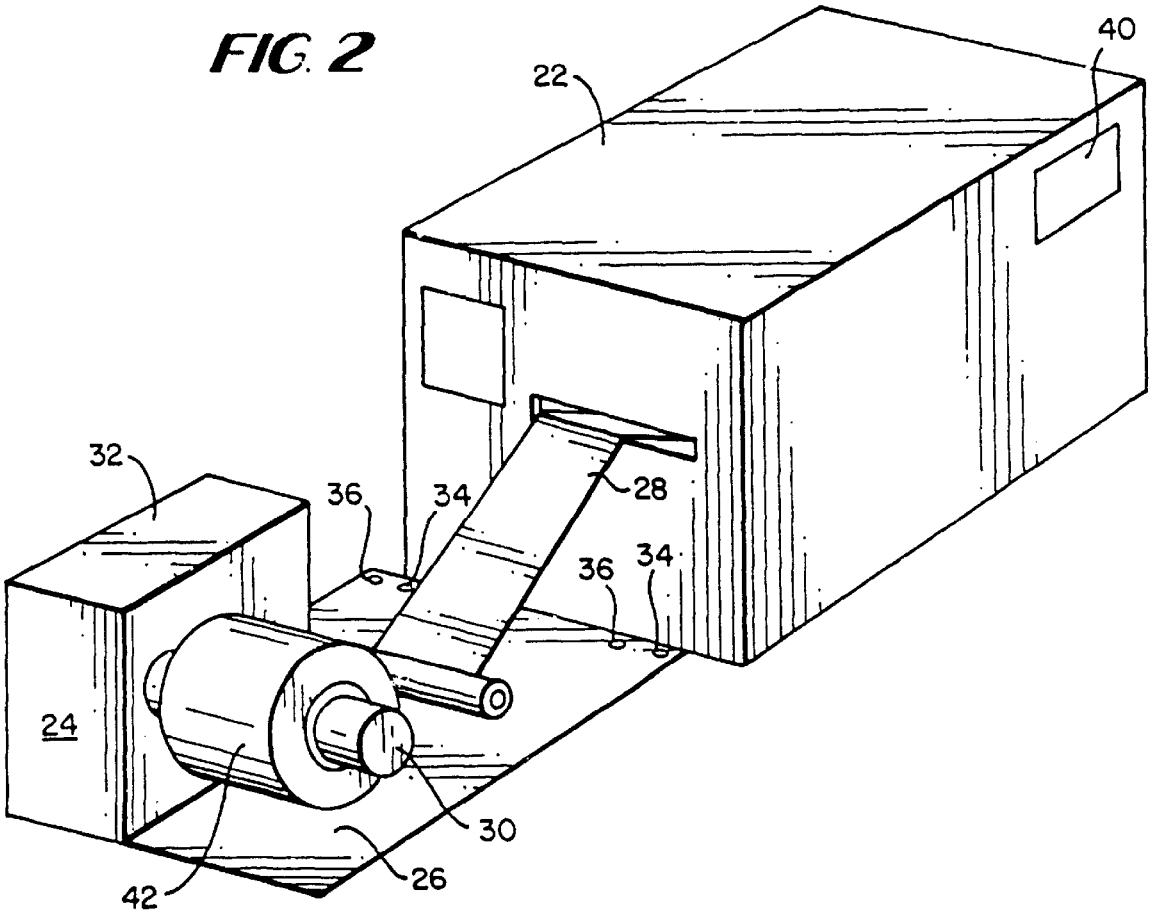
FIG. 2 illustrates the rewinding apparatus of the invention.

Referring to FIG. 2, the apparatus of the invention includes a thermal printer 22, a rewinder 24 and a base plate 26 supporting the rewinder 24. The printer 22 includes structure for preprinting the labels per customer specifications. The thermal printer may include a sensor 40, preferably a reflective sensor, that senses a sense mark on the unprinted roll of labels to register thermal printing. The structure of the thermal printer is generally known, and further description will not be provided. Those of ordinary skill in the art can readily select a suitable printer.

The rewinder 24 includes a rotatable shaft 30 secured to a main body 32. The rotatable shaft is rotated and controlled by any suitable structure. Preferably, the shaft is controlled by a dancer arm 33 that swings up and down with label tension. As the label goes slack, the dancer arm 33 moved downward, and the rewinder 24 accelerates to take up slack. As tension increases, the rewinder 24 slows down to reduce tension. In a preferred embodiment, the rewinder 24 is capable of rewind speeds up to 8 inches per second and of handling rewound rolls up to 8 inches in diameter.

The base plate 26 supports the rewinder 24 and serves as positioning means for the rewinder relative to the thermal printer 22. In a preferred embodiment, the base plate 26 includes two sets of location holes 34, 36 that are engageable with a corresponding set of location posts 38 of the thermal printer 22. A first set of location holes 34 engages the location posts 38 of the printer 22 such that the base plate 26 is offset from the printer 22 by a predetermined amount. In a preferred embodiment, the predetermined amount is about 0.375 inches.

In this configuration, the labels are rewound on the rotatable shaft 30 of the rewinder 24 such that the printer roll 42 is spaced from the main body 32 of the rewinder 24 by a corresponding amount. In a preferred embodiment, the corresponding amount is about 0.375 inches. The main body 32 is not used as a side guide for the printed roll because the linerless media adheres to itself once rewinding starts, and there is no chance for the media to slide off itself. The structure avoids the media's adhesive from catching on a side guide, thereby preventing bubbles and wrinkles in the rewound roll.

The second set of location holes 36 are provided for a conventional linered label that requires the main body 32 of the rewinder 24 to be used as a side guide. Of course, the base plate 26 may include location posts, as opposed to location holes, engageable with corresponding location holes in the printer.

In a similar manner, the rewinder 24 includes a set of location posts (not shown) engageable with an additional set of location holes (not shown) in the base plate 26 to secure the rewinder to the base plate.

The apparatus according to the invention is suitable for batch mode dispensing of labels. That is, the printer 22 can be configured to process a certain predetermined number of labels. The rewinder 24 can then rewind the labels onto the rotatable shaft 30 for subsequent use. Thus, an operator can customize a label operation both in the content of the label and in the number of labels.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An apparatus for winding a printed roll of linerless labels from an unprinted roll of linerless labels, the apparatus comprising:

a thermal printer that processes the unprinted roll of labels;

a rewinder disposed in a vicinity of said thermal printer; said rewinder winding said printed roll after said unprinted roll is processed by said thermal printer; and a base plate supporting said rewinder, said base plate being configured to position said rewinder in a predetermined position relative to said thermal printer, wherein said base plate is offset perpendicular to a direction of the winding from said thermal printer by a predetermined amount.

2. An apparatus according to claim 1, wherein said thermal printer comprises a sensor that senses a sense mark on said unprinted roll of labels to register thermal printer.

3. An apparatus according to claim 2, wherein said sensor is a reflective sensor.

4. An apparatus according to claim 1, wherein said predetermined amount is about 0.375".

5. An apparatus according to claim 1, wherein said rewinder comprises a rotatable shaft extending from a rewinder main body, said rotatable shaft supporting said printed roll, wherein said base plate is positioned relative to said thermal printer such that when said printed roll is wound on said rewinder, said printer roll is spaced from said rewinder main body.

6. An apparatus according to claim 5, wherein said printed roll is spaced about 0.375" from said rewinder body.

7. An apparatus according to claim 1, wherein said thermal printer comprises one of a location hole and a location post, and wherein said base plate comprises the other of the location hole and the location post, said base plate being positioned relative to said thermal printer by said location hole and said location post.

8. An apparatus according to claim 7, wherein said base plate comprises an additional one of said location hole and said location post that alternatively positions said base plate relative to said thermal printer.

9. An apparatus for winding a printed roll of linerless labels, the printed roll being dispensed from a printed roll dispenser, the apparatus comprising:

a rewinder disposed in a vicinity of said dispenser and comprising a rotatable shaft, said rewinder winding said printed roll on said shaft; and a base plate supporting said rewinder, said base plate being configured to position said rewinder in a predetermined position relative to said dispenser, wherein said base plate is offset perpendicular to a direction of the winding from said dispenser by a predetermined amount.

10. An apparatus according to claim 9, wherein said predetermined amount is about 0.375".

11. An apparatus according to claim 9, wherein said rotatable shaft extends from a rewinder main body, and wherein said base plate is positioned relative to said dispenser such that when said printed roll is wound on said rewinder, said printed roll is spaced from said rewinder main body.

12. An apparatus according to claim 11, wherein said printed roll is spaced about 0.375" from said rewinder body.

13. An apparatus according to claim 9, wherein said dispenser comprises one of a location hole and a location post, and wherein said base plate comprises the other of the location hole and the location post, said base plate being positioned relative to said dispenser by said location hole and said location post.

14. An apparatus according to claim 13, wherein said base plate comprises an additional one of said location hole and said location post that alternatively positions said base plate relative to said dispenser.

15. A method of winding a printed roll of linerless labels from an unprinted roll of linerless labels using a thermal printer that processes the unprinted roll of labels, a rewinder disposed in a vicinity of the thermal printer, the rewinder winding the printer roll after the unprinter roll is processed by the thermal printer, and a base plate supporting the rewinder, the base plate being configured to position the rewinder in a predetermined position relative to the thermal printer, the method comprising:

positioning said base plate and said rewinder offset perpendicular to a direction of winding relative to said thermal printer; and winding said printed roll onto said rewinder while maintaining said printed roll spaced from a main body of said rewinder.

16. A method according to claim 15, wherein said positioning step comprises positioning said base plate about 0.375" offset relative to said thermal printer.

17. A method according to claim 16, wherein said winding step comprises winding said printed roll onto said rewinder while maintaining said printed roll spaced about 0.375" from said main body.

18. A method of processing linerless labels, comprising:

(a) providing a supply of linerless labels having a thermosensitive coating on a first side and an adhesive coating on a second side;

(b) feeding the supply of linerless labels through a printer;

(c) configuring the printer to process a selected predetermined number of linerless labels;

(d) printing on one of the first and second sides of the linerless labels to produce at least a first batch;

(e) winding the first batch of printed linerless labels with a rewinder, the rewinder being offset perpendicular to a direction of winding; and (f) removing the first batch of printer linerless labels from the rewinder for subsequent application.

19. A method according to claim 18, wherein steps (c) through (e) are practiced to produce a second batch of linerless labels.

* * * * *